US006053492A

United States Patent [19]

Newsome

[11] Patent Number: 6,053,492

[45] Date of Patent: Apr. 25, 2000

[54] APPARATUS FOR SEQUENTIALLY FEEDING CARDS TO INSERTER IN A MAGAZINE BINDING LINE

[76] Inventor: John R. Newsome, R.R. #1, Box 119, Shumway, Ill. 62461

[21] Appl. No.: 08/810,296

[22] Filed: Mar. 3, 1997

[51] Int. Cl.[7] ..... B65H 3/12; B65H 3/08; B65H 3/46; B65H 1/24

[52] U.S. Cl. ..... 271/94; 271/99; 271/105; 271/166

[58] Field of Search ..... 271/14, 12, 124, 271/94, 10.04, 57.18, 2, 35, 196, 276, 99, 104, 105, 161, 166

[56] References Cited

U.S. PATENT DOCUMENTS

| | | | |
|---|---|---|---|
| 3,782,716 | 1/1974 | Long et al. | 271/99 |
| 4,134,579 | 1/1979 | Polarek et al. . | |
| 4,456,241 | 6/1984 | Newsome . | |
| 4,666,140 | 5/1987 | Godlewski | 271/35 |
| 4,681,311 | 7/1987 | Sardella | 271/11 |
| 4,771,896 | 9/1988 | Newsome . | |
| 5,072,922 | 12/1991 | Paulson | 271/99 |
| 5,088,717 | 2/1992 | Hamanaka et al. | 271/98 |
| 5,376,954 | 12/1994 | Kerr | 346/138 |
| 5,642,878 | 7/1997 | Smithe et al. | 271/109 |
| 5,772,200 | 6/1998 | Sorensen | 271/166 |

*Primary Examiner*—Donald P. Walsh
*Assistant Examiner*—Brett C Martin
*Attorney, Agent, or Firm*—Alston & Bird LLP

[57] ABSTRACT

An apparatus for sequentially feeding cards from the bottom of a vertical stack, which includes a card transport drum positioned below the stack so as to support the forward edge portion of the bottom of the stack. The drum includes a set of suction openings disposed transversely across the outer peripheral surface of the drum, and the openings are of oval outline. To sequentially feed the cards, the drum is rotated so that the openings move across the bottom of the lowermost card and the suction grips and holds the lowermost card on the surface of the drum, to thereby advance the lowermost card from the stack. The oval outline of the openings helps ensure that only the lowermost card is gripped and advanced by the suction openings. The apparatus also includes a vertically adjustable gate assembly mounted to overlie the forward edge of the stack and so as to define an outlet gate with respect to the drum, and a pair of rollers is mounted to the gate assembly which serves to reduce the weight of the stack at the gate.

22 Claims, 5 Drawing Sheets

10
12
14
14A
S
20
C
VAC.
81
46
83
AIR
82
86
87
88

APPARATUS FOR SEQUENTIALLY FEEDING CARDS TO INSERTER IN A MAGAZINE BINDING LINE

BACKGROUND OF THE INVENTION

It is common practice to insert post cards, advertising order cards, and the like in a magazine during the binding process, so that the cards are either anchored permanently in the binding for tearing off by the customer or loosely inserted.

U.S. Pat. No. 4,456,241 illustrates a card feeding apparatus wherein the cards are fed downwardly from a stack one-by-one for transport to an appropriate inserter in a binding line. The stack of cards is supported at its leading edge on a stripper-type support, and the bottom card is engaged by a sucker cup which moves vertically into engagement with the bottom card and then draws the card downwardly, causing it to "flick" over the stripper support. The card is then advanced horizontally into a feeding or pick up position. While the apparatus disclosed in the above referenced patent performs satisfactorily, it employs a rather complicated mechanism to impart the necessary vertical and horizontal movements to the lowermost card of the stack.

In another prior feeding apparatus, the suction cup feed system has been replaced by a rotating card transport drum, which includes a circular suction opening on its peripheral surface. The drum is positioned to underlie and support the stack of cards, and as the drum rotates, a vacuum is drawn in the suction opening during its passage beneath the stack so as to engage the lowermost card and advance it forwardly into the nip of a conveyor feeding system.

The use of a rotating feed drum as described above provides a structurally simplified arrangement for engaging and advancing the lowermost card. However, when relatively thin cards of about 3 to 5 thousands of an inch are being handled, the force of the vacuum often tends to bleed through the lowermost card and also grip the next adjacent card, with the result that the two cards are fed together to the pick up point.

It is accordingly an object of the present invention to provide an apparatus for sequentially feeding cards from the bottom of a vertical stack, and which employs an improved card transport drum which avoids the disadvantages and limitations of the prior drums as described above.

It is a more particular object of the present invention to provide a card feeding apparatus which is highly efficient in sequentially delivering only a single card from the bottom of a vertical stack.

It is also an object of the present invention to provide an apparatus of the described type which is highly reliable, which is capable of working at the fastest commercial feeding speeds, and which is capable of operating continuously over long periods of time without attention, maintenance, or adjustment.

SUMMARY OF THE INVENTION

The above and other objects and advantages of the present invention are achieved by the provision of an apparatus for sequentially feeding cards from the bottom of a generally vertical stack which includes a rear edge, a forward edge, and which defines a forward direction extending from the rear edge toward the forward edge. The vertical stack is supported by a rear platform which underlies the rear edge portion of the stack and a vertical guide member which overlies the forward edge of the stack and which is forwardly spaced from the rear platform so as to define a downwardly open access window therebetween. A card transport drum is provided which has a cylindrical peripheral surface, with the drum being mounted for rotation about an axis which is transverse to the forward direction and so that an upper peripheral portion of the drum extends across the access window so as to underlie and support the forward edge portion of the stack. A gate is thereby formed between the peripheral surface of the drum and the lower edge of the vertical guide member.

At least one suction opening communicates with the peripheral surface of the drum, with the one suction opening being of oval outline with the major dimension thereof being aligned with the circumferential direction of the peripheral surface of the drum. Also, drive means is provided for rotating the drum about the transverse axis, and such that the one suction opening moves forwardly across the access window once during each rotation of the drum. A suction is drawn in the one suction opening during at least a portion of the movement of the one suction opening across the access window, so that the rotating drum grips the lowermost card of the stack and advances it forwardly from the stack and through the gate.

Preferably, a resilient O-ring is mounted in the suction opening so as to encompass the periphery of the opening and so that a portion of the O-ring extends above the peripheral surface of said drum. Also, in the preferred embodiment, a plurality of the suction openings of like size and configuration are disposed transversely across the peripheral surface of said drum.

It has been found that an oval configuration of the suction openings, as described above, exerts a greater suction pulling force against the lowermost card, and this greater force acts to more reliably break the natural seal between the lowermost card and the card next above it. This in turn assures that only the lowermost card is advanced from the stack.

The vertical guide member preferably includes a lower edge which comprises a central portion which is spaced above the peripheral surface of said drum, and a pair of extensions which extend downwardly below the central portion and so as to straddle the peripheral surface of the drum, and such that the lowermost card in the stack is deflected along each of its side edges as it is moved forwardly by the rotating drum. Such deflection of the lowermost card serves to stiffen the card as it is moved through the gate and it also helps to separate the lowermost card from the next card above it in the stack.

As a further aspect of the present invention, the vertical guide member is vertically adjustable to adjust the vertical dimension of the gate, and thus accommodate cards of varying thickness. Also, a pair of rollers, which collectively has a substantial axial dimension as compared to the transverse width of the forward edge of the stack of cards, is mounted to the vertical guide member at a location above the gate and so as to engage and deflect the forward edge of the stack and support a portion of the weight of the stack. This permits a large number of cards to be placed in the stack, without having its weight interfere with the ability of the card transport drum to remove the cards one at a time from the bottom of the stack.

BRIEF DESCRIPTION OF THE DRAWINGS

The above and other objects and advantages of the invention will become apparent from the following detailed description and when considered in conjunction with the accompanying drawings, in which.

DETAILED DESCRIPTION OF A PREFERRED EMBODIMENT

Referring more particularly to the drawings, a dual card feeding apparatus which embodies the present invention is illustrated generally at 10, and which comprises a frame 12 which mounts two parallel card support chutes 14 and 14A. Each card support chute is designed to support a plurality of cards C in a generally vertical stack S, and with the two chutes being of like construction.

Figure 3:
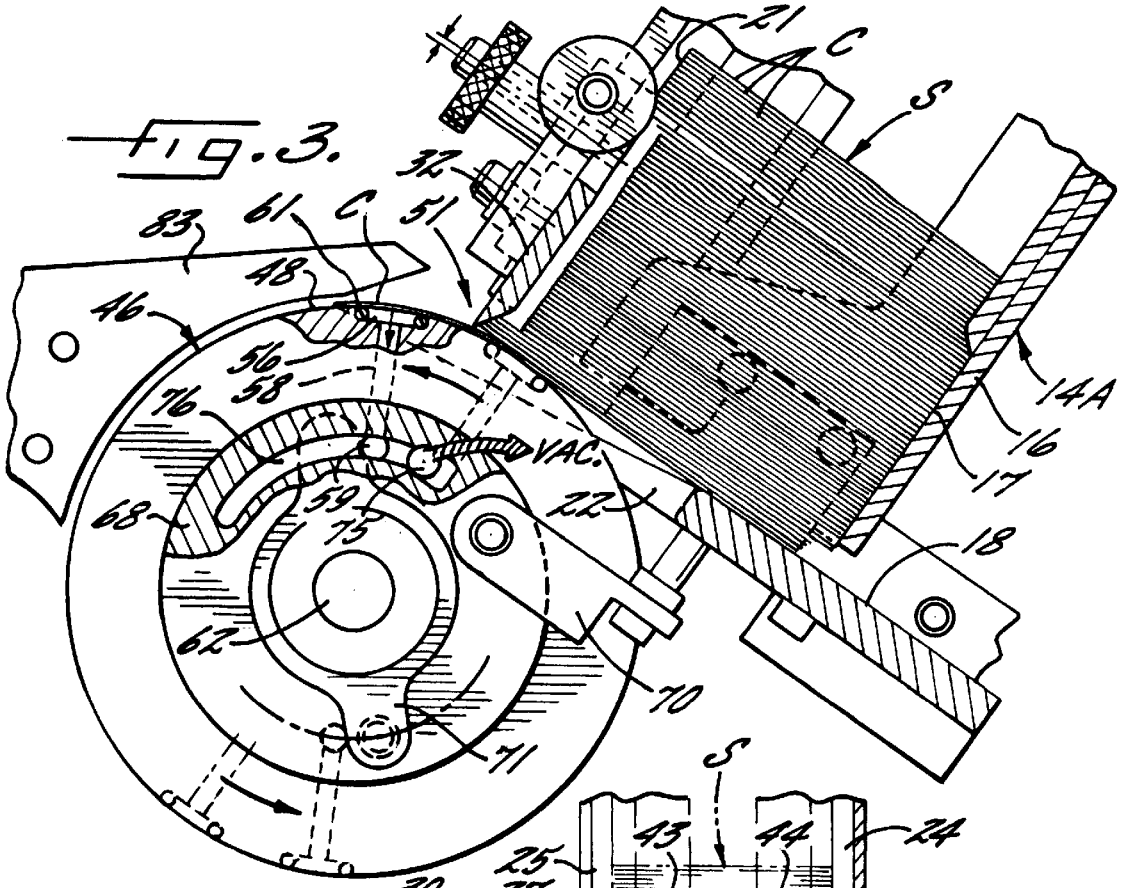
FIG. 3 is an enlarged fragmentary view of a portion of the apparatus as shown in FIG. 1.

More particularly, and as best seen in FIG. 3, each card support chute 14 and 14A comprises an upright rear panel 16 for supporting the rear edge 17 of the stack. Also, a rear platform 18 underlies the rear edge portion of the stack and a gate assembly 20 overlies the forward edge 21 of the stack. The gate assembly 20 is forwardly spaced from the rear platform 18 so as to define a downwardly open access window 22 therebetween.

Each card support chute 14 and 14A also includes a pair of opposite side panels 24,25 for supporting the opposite side edges 26,27 of the stack of cards, and an air jet system in the form of an outlet nozzle 28 is mounted adjacent the bottom of each side panel 24,25 for directing a continuous stream of air into the two side edges 26,27 of the stack adjacent the lowermost card. A similar outlet nozzle may be positioned to direct an airstream into the rear edge of the stack, which is not shown. These air streams facilitate the release of the lowermost card from the remaining cards.

Figure 5:
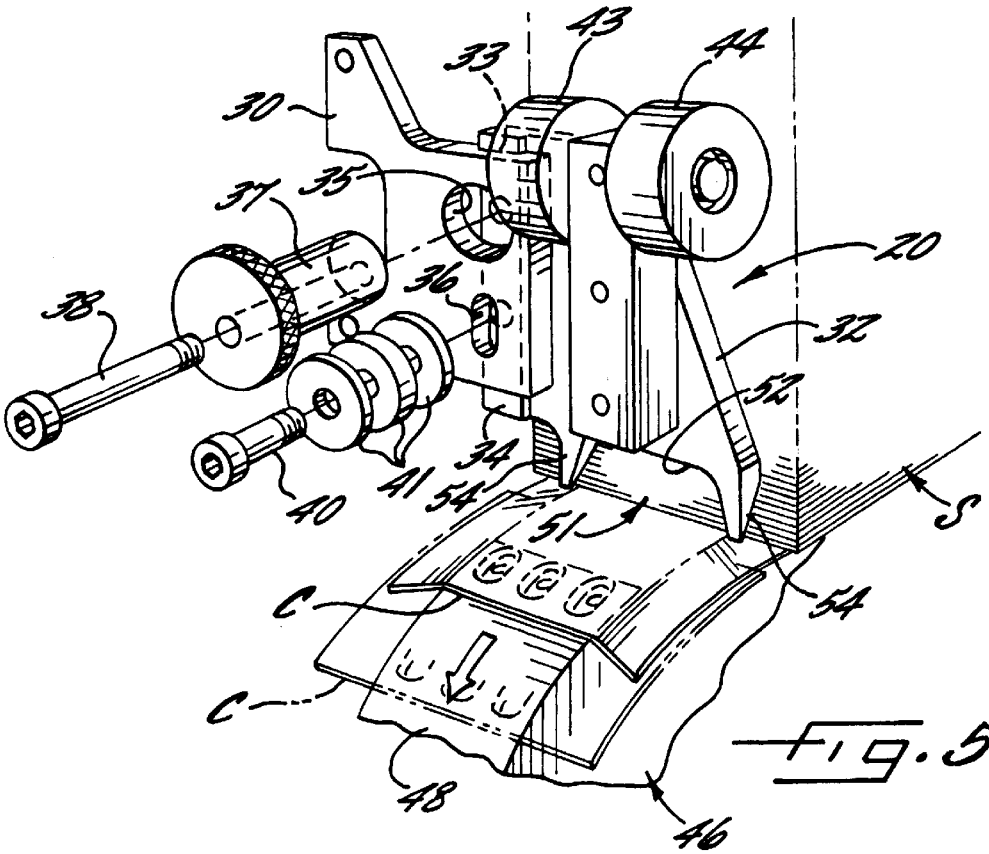
FIG. 5 is a perspective view of the gate assembly of the apparatus.
Figure 6:
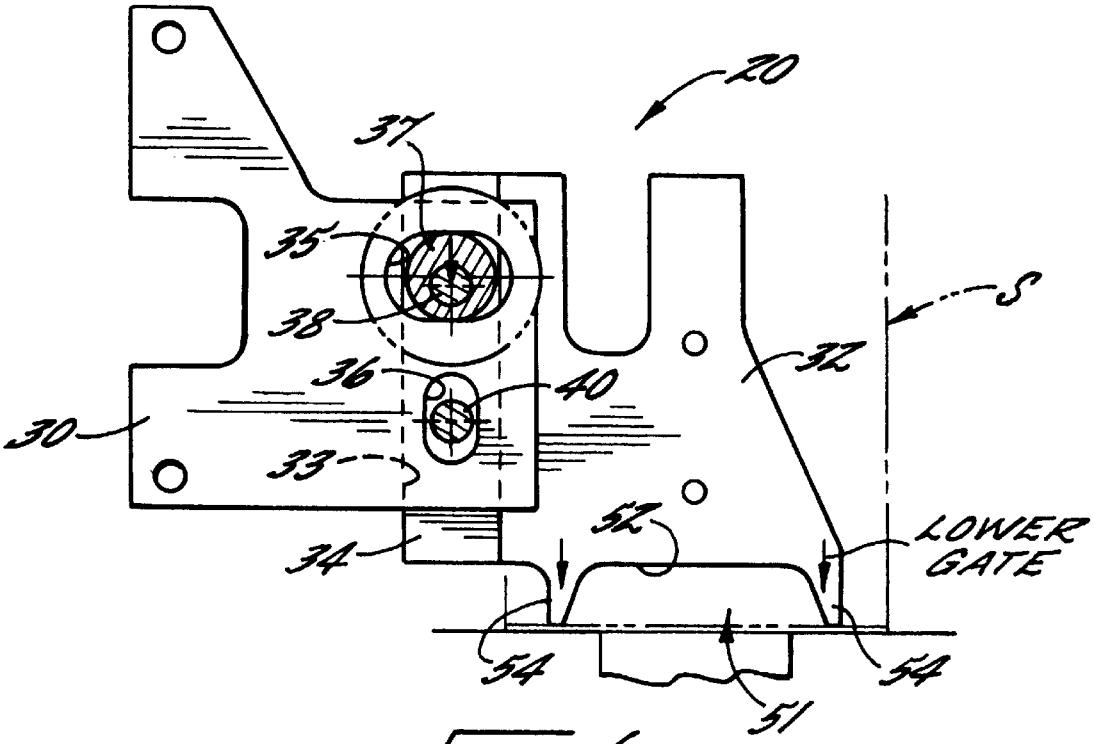
FIG. 6 is a partly sectioned plan view of the gate assembly with the guide member in a lowered position.
Figure 7:
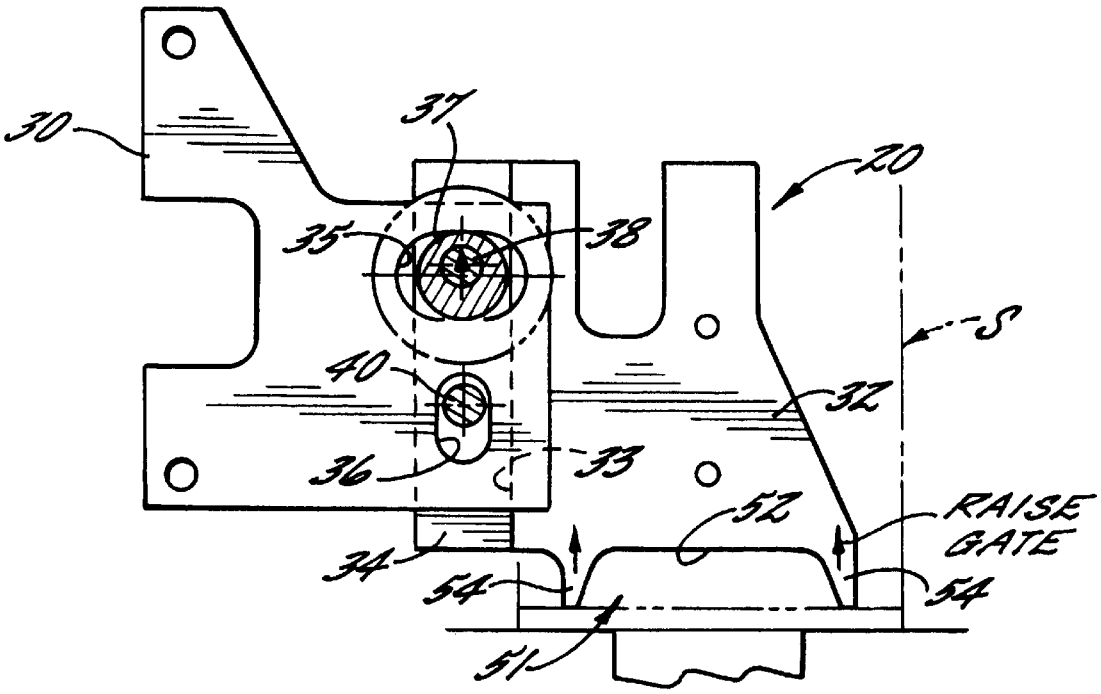
FIG. 7 is a view similar to FIG. 6 but showing the guide member in a raised position.
Figure 8:
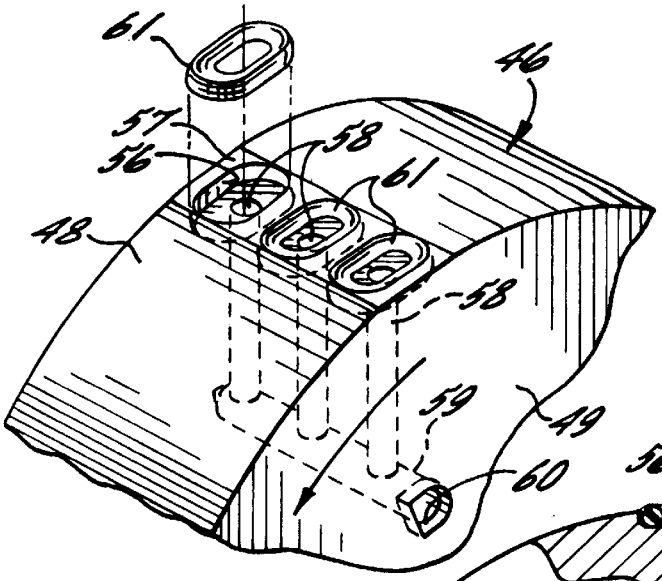
FIG. 8 is a fragmentary perspective view of one of the card transport drums of the apparatus.
Figure 9:
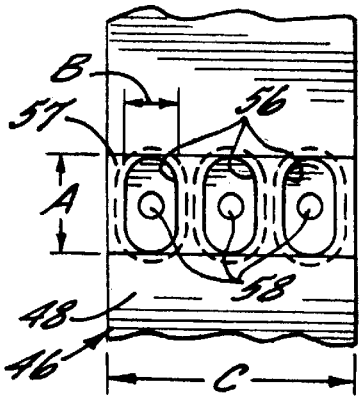
FIG. 9 is a fragmentary front view of the drum and showing the oval outline of the suction openings therein.

As best seen in FIGS. 5–7, the gate assembly 20 includes a support bracket 30 which is fixed to the frame of the apparatus, and a vertical guide member 32 which is mounted for slidable movement in the vertical direction on the support bracket 30. More particularly, the support bracket 30 has a vertical channel 33 in its rear surface, and the guide member 32 has an extension 34 which is closely received in the channel 33. Also, the support bracket 30 has an upper horizontal slot 35 and a lower vertical slot 36. An eccentric post 37 is rotatably mounted on a pin 38 which is threaded into a bore of the guide member 32 and so that the eccentric post 37 is received within the upper slot 35. Also, a second pin 40 extends through a number of washers 41 and through the lower slot 36 and is threaded into a second bore of the guide member 32. As will be apparent, rotation of the eccentric post 37 causes it to be biased against either the upper or lower edge of the upper slot 35, which in turn causes the guide member 32 to be lowered (FIG. 6) or raised (FIG. 7).

The gate assembly 20 further includes a pair of rollers 43,44 mounted to the vertical guide member 32 for rotation about a transverse axis and at a location above the lowermost card of the stack. The rollers 43,44 are also positioned so as to engage and deflect the forward edge of the downwardly moving stack and so that a portion of the weight of the stack is supported by the rollers as further explained below.

A card transport drum 46 is mounted below each of the two stacks S of cards, and each drum has a cylindrical peripheral surface 48 and a smooth side surface 49. Also, each drum is mounted for rotation about an axis which is transverse to the forward direction and so that an upper peripheral portion of the drum extends across the access window 22 so as to underlie and support the forward edge portion of the associated stack. Each drum is also located so as to define a gate 51 between the drum and the lower edge of the vertical guide member 32. More particularly, the lower edge of the vertical guide plate 32 includes a central portion 52 which is spaced above the peripheral surface 48 of the drum 46, and a pair of transversely spaced apart extensions 54 which extend downwardly from the central portion 52 and so as to straddle the peripheral surface 48 of the drum. This configuration of the lower edge acts to deflect the lowermost card C as it exits through the gate, note FIG. 5, to provide the advantages noted above.

As best seen in FIGS. 4 and 8–10, two sets of suction openings 56 are formed in the peripheral surface 48 of each drum, with each set comprising three separate openings 56 which are aligned transversely across the peripheral surface. The two sets of openings are diametrically aligned and so as to be spaced apart 1800 around the peripheral surface 48 of the drum. Also, each set of openings is preferably formed on a flat 57 which is milled into the peripheral surface 48 before the openings are formed. The three openings of each set are of the same outline and size in the illustrated embodiment, and each is of oval outline. Also, the major dimension A of each opening is aligned with the circumferential direction of the peripheral surface 48 of the drum, and the minor dimension B is aligned with the axial or transverse direction of the drum.

Each of the three openings 56 of each set communicates with a separate radial bore 58 in the drum, and the radial bores 58 in turn communicate with a transverse air feed line 59 which opens onto the outer side edge surface of the drum by means of a D-shaped opening 60.

Figure 10:
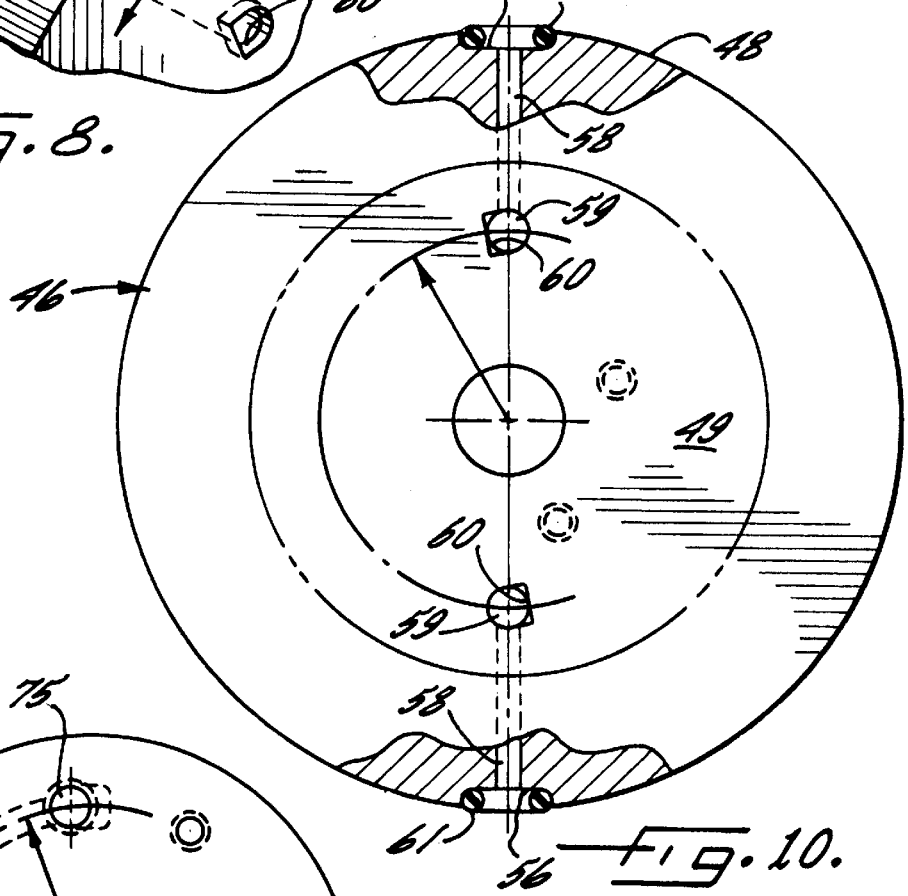
FIG. 10 is a side elevation view, partly sectioned, of one of the card transport drums.
Figure 11:
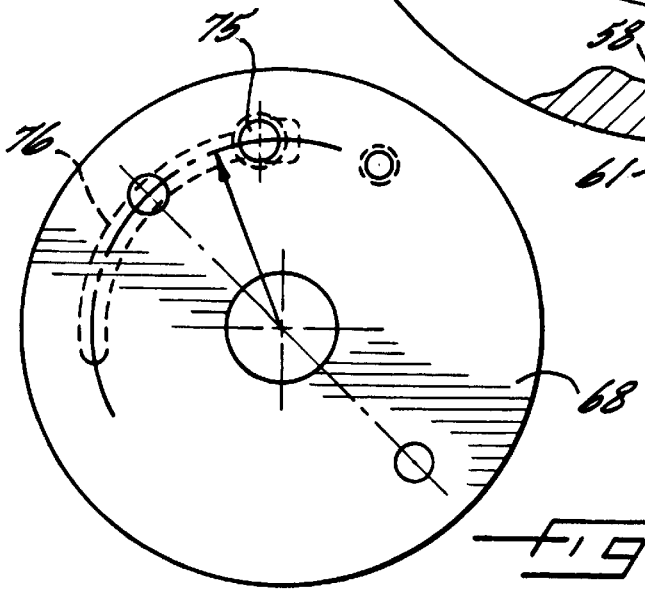
FIG. 11 is a side elevation view of one of the suction plates of the apparatus.

A resilient O-ring 61 is mounted in each of the three openings 56 of each set so as to encompass the periphery of the opening and so that a portion of the O-ring extends above the peripheral surface 48 of the drum. More particularly, each opening 56 includes an arcuate undercut along its periphery, which is configured to receive a portion of the O-ring 61 therein, as best seen in FIG. 10. The O-ring is thereby retained in the opening. Also, the O-ring is preferably composed of a suitable rubber-like material, such as neoprene or nitrile, and each O-ring is naturally of a circular outline so that it is deformed when it is inserted into the undercut of the opening.

As a specific and nonlimiting example, each card transport drum 46 has a diameter of about 7.2 inches and a transverse width C of about 1.75 inches. Each flat 57 has a peripheral width of about 0.68 inches, and the three openings 56 of each set are equally spaced in the transverse direction on a flat 57. Also, each opening 56 has a major dimension A of about 0.68 inches and a minor dimension B of about 0.39 inches.

Figure 2:
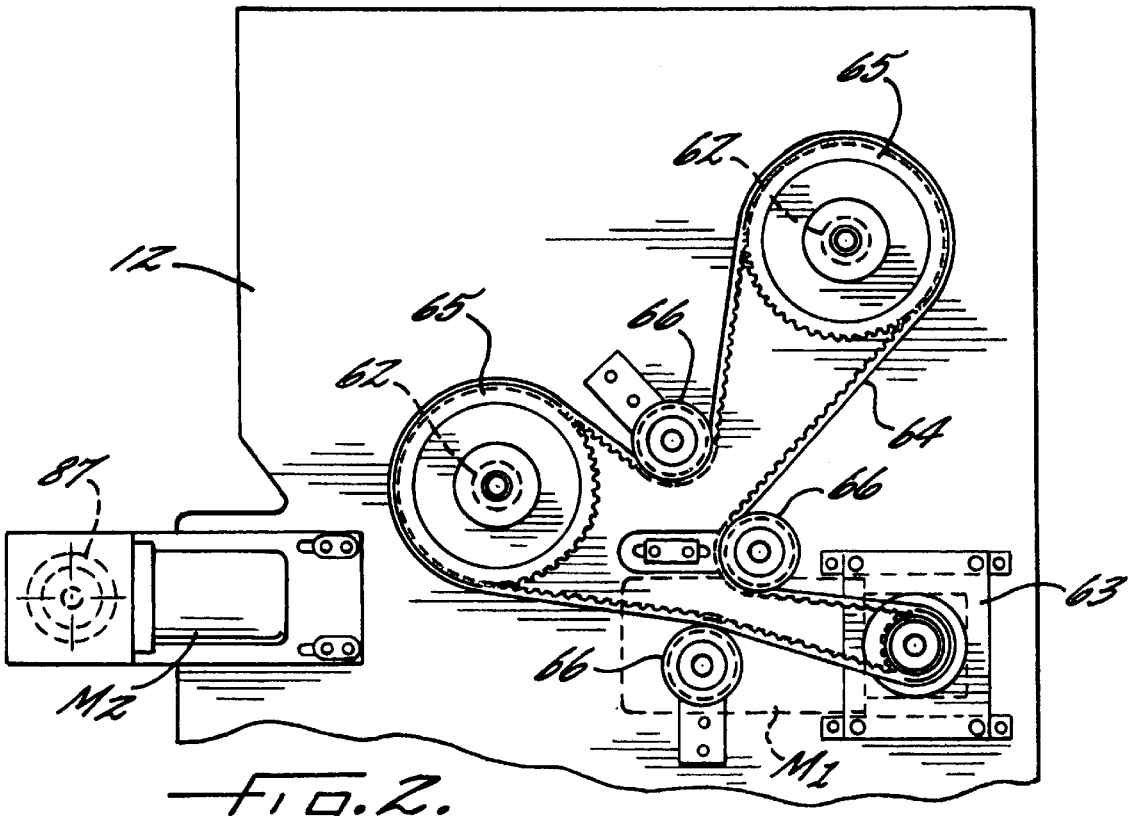
FIG. 2 is a fragmentary side elevation view facing in a direction opposite that of FIG. 1 and viewing the drive components of the apparatus.

Each drum 46 is fixed to a rotatable drive shaft 62, and the two shafts 62 are driven in unison by a drive motor M1 acting through a gear box 63, a drive belt 64 and a pulley 65 which is fixed to each drive shaft 62. As best seen in FIG. 2, the drive belt 64 loops about each of the pulleys 65, and is guided by three guide pulleys 66 which maintain a desired tension in the belt 64.

A suction system is also provided for each drum 46 and which acts to draw a suction in each of the openings 56 of each set as the openings move across the access window 22. Thus the drum 46 grips the lowermost card C of the stack and advances it forwardly from the stack and through the associated gate 51. The suction system includes a suction plate 68 which overlies the outer side surface 49 of the drum and which is coaxially mounted on the drive shaft 62 by means of a bearing surface therebetween, and so that the suction plate 68 does not rotate with the shaft 62 and so that it is axially slidable on the shaft. The suction plate 68 is held against rotation by means of a bracket 70 (FIG. 3) which is in turn fixed to the rear platform 18 and thus the frame of the machine.

A back-up plate 71 is also rotatably mounted on the drive shaft 62, and the back-up plate is held against rotation and against axial sliding movement away from the suction plate by means of a nut 72 which is threaded on the end of the drive shaft. Also, a plurality of springs 73 are interposed between the back-up plate 71 and the suction plate 68 so as to bias the suction plate into firm engagement with the smooth side surface 49 of the drum.

The suction plate 68 further includes an internal suction line 75 which communicates with an arcuate slot 76 in its side face which overlies the side surface 49 of the drum, and which is radially aligned with the opening 60 of the drum. The outer end of the internal suction line 75 is fixed to a vacuum line 77 which leads through the back-up plate 71 to a suitable vacuum source (not shown).

Figure 1:
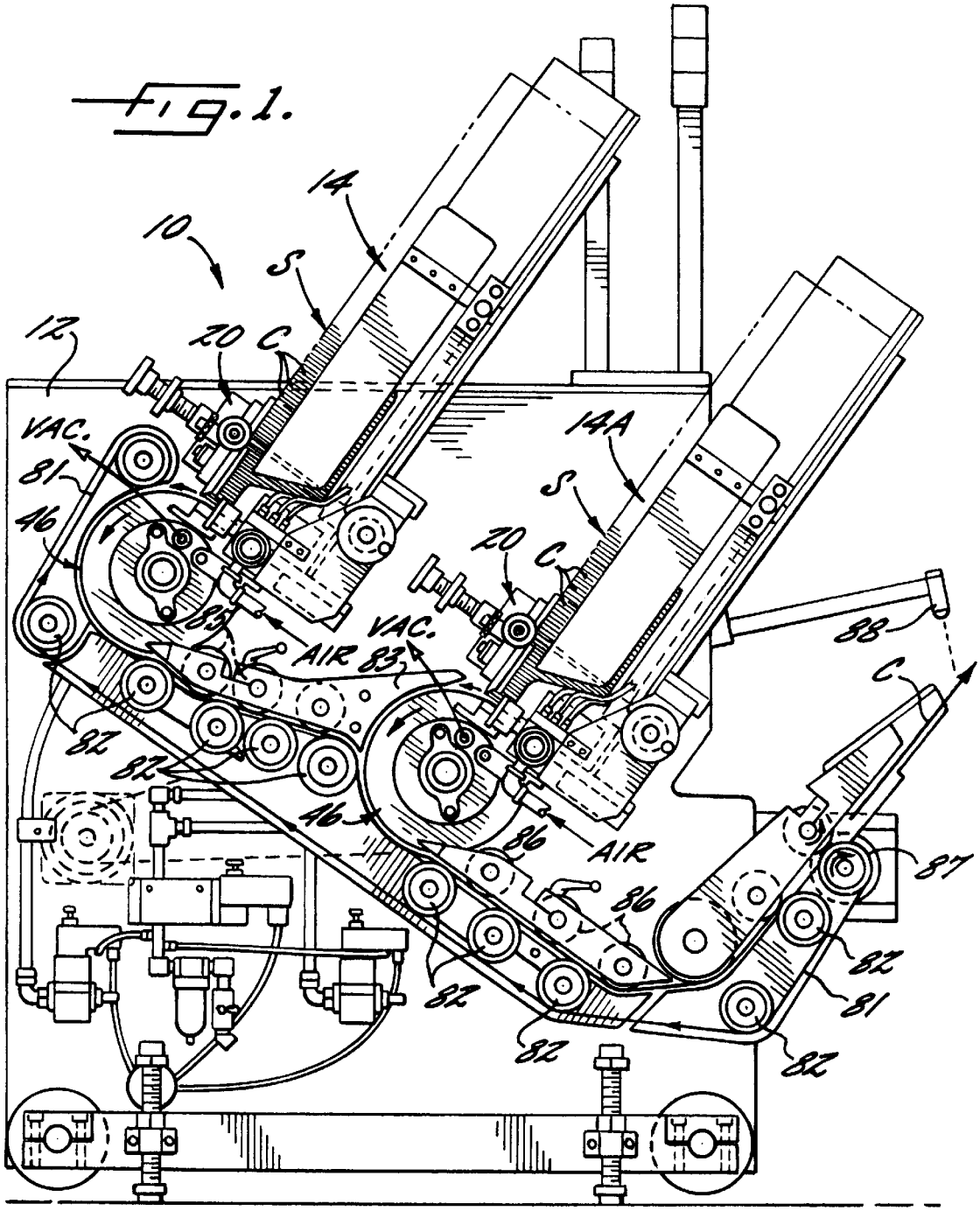
FIG. 1 is a side elevational view of a card feeding apparatus constructed in accordance with the present invention.

To feed the cards which are delivered from the bottom of each stack to an appropriate inserter in a binding line or the like, there is provided a conveyor assembly 80 which includes a belt 81 which is entrained about a number of rollers 82. The rollers 82 are positioned to guide the belt 81 into contact with a portion of the periphery of each drum 46, and the belt 81 thus forms a nip with each drum which is adapted to sequentially receive the cards from the rotating drum. Also, this contact between the belt 81 and each drum 46 serves to advance the belt at a speed corresponding to the peripheral speed of the two drums. The nip formed between the belt 81 and the first drum 46 (i.e. the drum on the left as seen in FIG. 1) is immediately downstream of the associated gate, but the nip formed with the second or downstream drum is circumferentially spaced from the associated gate a substantial distance. To retain the cards in contact with the surface of the second drum between the gate and the nip of the second drum, there is provided an arcuate guide plate 83 which overlies the peripheral surface 48 of the drum across this distance.

Downstream of the first drum 46, a first series of rollers 85 is provided for maintaining the cards in contact with the belt 81 as they advance to the nip formed with the second drum 46, and downstream of the second drum, a second series of rollers 86 is provided for maintaining the cards in contact with the belt, and so that the cards are sequentially delivered to the downstream end of the conveyor assembly 80. At the downstream end, the cards are delivered to the nip of a speed-up roller assembly 87, which is driven at a speed greater than the speed of the conveyor assembly 80 by the motor M2 (FIG. 2) and so that the cards are advanced from conveyor assembly at a relatively high speed. From the speed-up roller assembly 87, the cards continue to advance to an inserter (not shown) or other suitable processing device in a conventional manner. Also, a sensor 88 may be mounted adjacent the speed-up roller assembly to monitor the sequence being delivered to the inserter, as is conventional.

In operation, a stack of cards is loaded into each delivery chute 14 and 14A, and so that in each case the rear portion of the lowermost card rests upon the rear platform 18 and the forward portion of the lowermost card rests upon the peripheral surface 48 of the associated drum 46. The motor M1 is then activated, causing the two drums 46 to rotate in a counterclockwise direction as illustrated in FIG. 1, at the same rotational speed. Also, the motor M2 is activated to rotate the speed-up roller assembly 87, and the suction system is activated.

Figure 4:
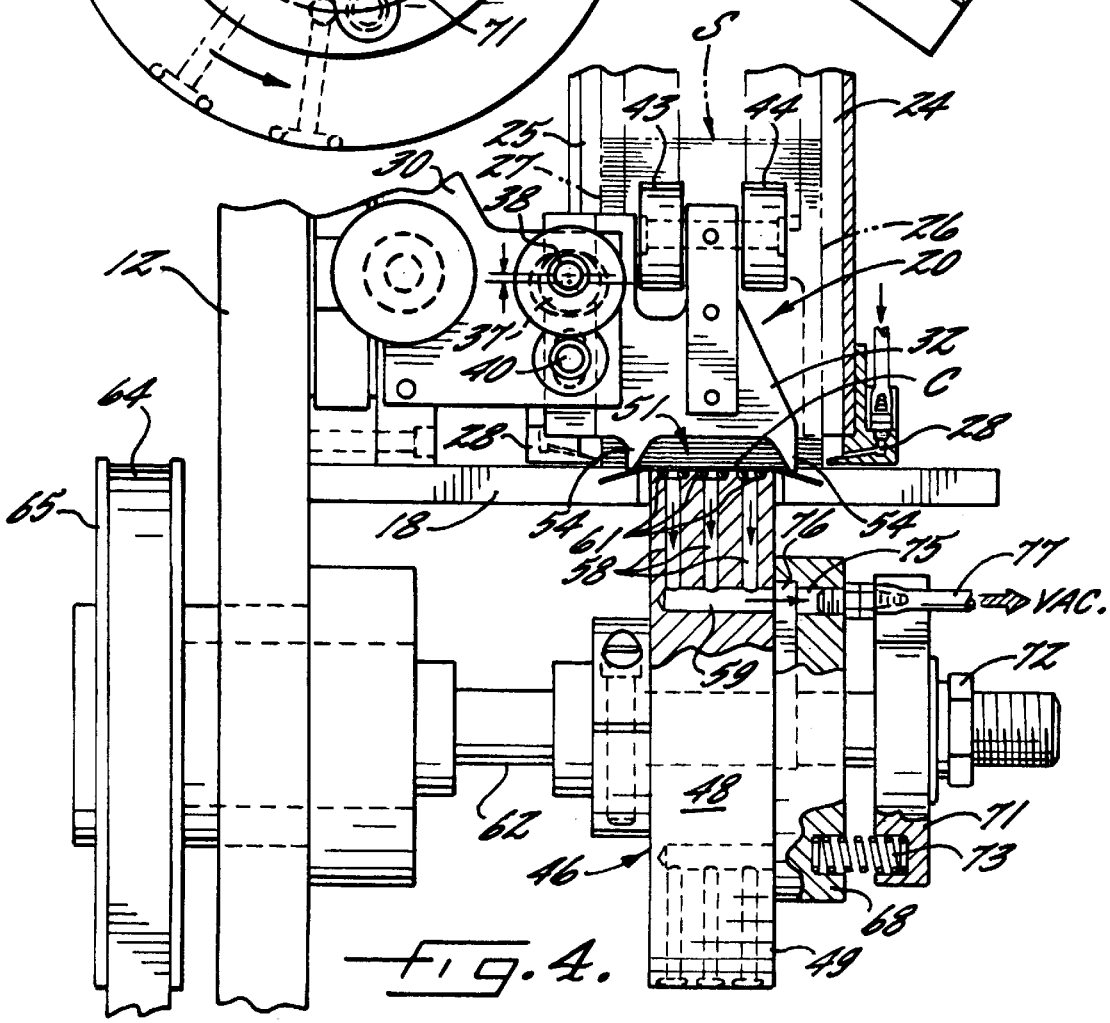
FIG. 4 is a fragmentary front elevation view, partly sectioned, of the portions of the apparatus shown in FIG. 2.

As each set of three openings 56 advances forwardly across the access window 22 of each chute, the suction openings 56 come into communication with the slot 76 in the suction plate 68, causing a partial vacuum to be drawn in each of the three openings 56. As a result, the lowermost card C is gripped and held against the rotating drum, and it is thereby advanced forwardly into the associated nip formed by the drive belt 81 of the conveyor assembly 80. Also, as best seen in FIG. 4, the two side edges of the card C are deflected downwardly by the extensions 54 of the vertical guide member 32 as it passes through the gate. In a dual card feeder as illustrated, the timing of the feed of the cards from the two chutes is coordinated so that a card from the first chute overlies a card fed from the second chute, and so that the two overlying cards are fed together through the speed-up roller assembly 87 and to the downstream inserter.

The vertical guide member 32 of each chute is vertically adjustable in the manner described above so as to permit the opening between the peripheral surface of the drum and the lower edge of the vertical guide member at the gate 51 to be adjusted to accommodate cards of varying thickness and to insure that the cards are fed one at a time. Also, and as best seen in FIG. 4, the two guide rollers 43,44 are preferably spaced apart in the axial direction so as to have an overall transverse length which is at least equal to one half the traverse distance between the side panels 24,25 of the chute and the transverse width of the forward edge of the stack of cards. This substantial transverse extent of the support provided by the rollers 43,44 helps not only to reduce the weight of the stack at the gate, and thereby facilitate the singular delivery of the lowermost cards, but the rollers also help to preclude tilting of the stack at the gate which could also interfere with the singular delivery of the cards.

In the drawings and the specification, there has been set forth preferred embodiments of the invention, and although specific terms are employed, the terms are used in a generic and descriptive sense only and not for the purpose of limitation, the scope of the invention being set forth in the following claims.

That which is claimed:

1. An apparatus for sequentially feeding cards along a path of travel, and comprising means for supporting a plurality of cards in a generally vertical stack such that the stack includes a rear edge, and a forward edge, and defines a forward direction extending from the rear edge toward the forward edge, said supporting means including a rear platform underlying the rear edge portion of the stack and a vertical guide member overlying the forward edge of the stack and being forwardly spaced from the rear platform so as to define a downwardly open access window therebetween, a card transport drum having a cylindrical peripheral surface, said drum being mounted for rotation about an axis which is transverse to said forward direction and so that an upper peripheral portion of the drum extends across said access window so as to underlie and support the forward edge portion of the stack and so that a gate is formed between the drum and the vertical guide member, at least one suction opening communicating with the peripheral surface of said drum, with the one suction opening being of oval outline with the major dimension thereof being aligned with the circumferential direction of the peripheral surface of the drum, drive means for rotating the drum about said transverse axis, and such that the one suction opening moves forwardly across the access window once during each rotation of the drum, suction means for drawing a suction in said one suction opening during at least a portion of the movement of the one suction opening across the access window, so that the drum grips the lowermost card of the stack and advances it forwardly from the stack and through said gate, and a resilient O-ring mounted in said suction opening so as to encompass the periphery of the opening and so that a portion of the O-ring extends above the peripheral surface of said drum.

2. The apparatus as defined in claim 1 wherein a plurality of said suction openings of like size and configuration are disposed transversely across said peripheral surface of said drum, and wherein a resilient O-ring is mounted in each of said suction openings so as to encompass the periphery of the opening and so that a portion of each O-ring extends above the peripheral surface of said drum.

3. The apparatus as defined in claim 2 wherein said peripheral surface of said drum includes a flat upon which said plurality of suction openings are formed.

4. The apparatus as defined in claim 3 wherein said flat has a peripheral width which approximately equals the major dimension of said openings.

5. The apparatus as defined in claim 1 wherein said vertical guide member includes a lower edge which comprises a central portion which is spaced above the peripheral surface of said drum, and a pair of transversely spaced apart extensions which extend downwardly from the central portion and so as to straddle the peripheral surface of the drum, and such that the lowermost card in the stack is deflected along each of its side edges as it is advanced forwardly by the rotating drum through said gate.

6. The apparatus as defined in claim 1 wherein the stack of cards further defines opposite side edges, and wherein said apparatus further comprises air jet means for directing a continuous stream of air into at least one of said opposite side edges of the stack adjacent the lowermost card, and so as to facilitate the release of the lowermost card from the remaining cards.

7. The apparatus as defined in claim 1 wherein said supporting means further comprises roller means mounted at a location above the upper peripheral surface of the drum and so as to engage and deflect the forward edge of the stack and so that a portion of the weight of the stack is supported by the roller means.

8. The apparatus as defined in claim 7 wherein said roller means has a transverse length which is at least equal to about one half the transverse width of said forward edge of said stack of cards so as to help preclude tilting of the stack at said gate.

9. An apparatus for sequentially feeding cards along a path of travel, and comprising means for supporting a plurality of cards in a generally vertical stack such that the stack includes a rear edge, and a forward edge, and defines a forward direction extending from the rear edge toward the forward edge, said supporting means including a rear platform underlying the rear edge portion of the stack and a vertical guide member overlying the forward edge of the stack and being forwardly spaced from the rear platform so as to define a downwardly open access window therebetween, a card transport drum having a cylindrical peripheral surface, said drum being mounted for rotation about an axis which is transverse to said forward direction and so that an upper peripheral portion of the drum extends across said access window so as to underlie and support the forward edge portion of the stack and so that a gate is formed between the drum and the vertical guide member, at least one suction opening communicating with the peripheral surface of said drum, drive means for rotating the drum about said transverse axis, and such that the one suction opening moves forwardly across the access window once during each rotation of the drum, suction means for drawing a suction in said one suction opening during at least a portion of the movement of the one suction opening across the access window, so that the drum grips the lowermost card of the stack and advances it forwardly from the stack and through said gate, and roller means mounted for free rotation about an axis which is parallel to said transverse axis of rotation of said card transport drum and at a location above said gate and so as to engage and deflect the forward edge of the stack and so that a portion of the weight of the stack is supported by the roller means, said roller means having a continuous peripheral surface and having a transverse length which is at least equal to about one half the transverse width of said forward edge of said stack of cards so as to help preclude tilting of the stack at said gate.

10. The apparatus as defined in claim 9 wherein said vertical guide member includes a lower edge which comprises a central portion which is spaced above the peripheral surface of said drum, and a pair of transversely spaced apart extensions which extend downwardly from the central portion and so as to straddle the peripheral surface of the drum, and such that the lowermost card in the stack is deflected along each of its side edges as it is advanced forwardly by the rotating drum through said gate.

11. The apparatus as defined in claim 10 wherein said vertical guide member is mounted so as to be vertically adjustable with respect to said card transport drum and so that the vertical dimension of said gate can be varied.

12. The apparatus as defined in claim 11 wherein said roller means is mounted to said vertical guide member.

13. The apparatus as defined in claim 12 wherein said roller means comprises a pair of coaxial rollers which are axially spaced apart.

14. The apparatus as defined in claim 10 wherein said one suction opening is of oval outline with the major dimension thereof being aligned with the circumferential direction of the peripheral surface of the drum.

15. The apparatus as defined in claim 14 wherein a resilient O-ring is mounted in said suction opening so as to encompass the periphery of the opening and so that a portion of the O-ring extends above the peripheral surface of said drum.

16. The apparatus as defined in claim 9 wherein the stack of cards further defines opposite side edges, and wherein said apparatus further comprises air jet means for directing a continuous stream of air into at least one of said opposite side edges of the stack adjacent the lowermost cards, and so as to facilitate the release of the lowermost card from the remaining cards.

17. The apparatus as defined in claim 1 wherein said one suction opening includes an arcuate undercut about its periphery and which is configured to receive a portion of the resilient O-ring therein.

18. The apparatus as defined in claim 17 wherein said resilient O-ring is naturally of a circular outline so that it is deformed when it is inserted into the arcuate undercut about the suction opening.

19. The apparatus as defined in claim 9 further comprising a rear panel which is generally parallel to said vertical guide member and positioned to overlie the rear edge of the stack, and wherein said supporting means is oriented with respect to the horizontal so that the stack of cards is urged by gravity rearwardly against the rear panel.

20. The apparatus as defined in claim 19 wherein said rear panel has an offset at a location generally aligned with said roller means so as to accommodate a rearward deflection of the cards as they reach the level of said roller means.

21. An apparatus for sequentially feeding cards along a path of travel, and comprising means for supporting a plurality of cards in a generally vertical stack such that the stack includes a rear edge, and a forward edge, and defines a forward direction extending from the rear edge toward the forward edge, said supporting means including a rear platform underlying the rear edge portion of the stack and a vertical guide member overlying the forward edge of the stack and being forwardly spaced from the rear platform so as to define a downwardly open access window therebetween, a card transport drum having a cylindrical peripheral surface, said drum being mounted for rotation about an axis which is transverse to said forward direction and so that an upper peripheral portion of the drum extends across said access window so as to underlie and support the forward edge portion of the stack and so that a gate is formed between the drum and the vertical guide member, at least one suction opening communicating with the peripheral surface of said drum, drive means for rotating the drum about said transverse axis, and such that the one suction opening moves forwardly across the access window once during each rotation of the drum, suction means for drawing a suction in said one suction opening during at least a portion of the movement of the one suction opening across the access window, so that the drum grips the lowermost card of the stack and advances it forwardly from the stack and through said gate, and said vertical guide including a lower edge which comprises a central portion which is spaced above the peripheral surface of said drum, and a pair of transversely spaced apart extensions which extend downwardly from the central portion and so as to straddle the peripheral surface of the drum, and such that the lowermost card in the stack is deflected along each of its side edges by said extensions as it is advanced forwardly by the rotating drum through said gate.

22. The apparatus as defined in claim 21 wherein said vertical guide member is mounted so as to be vertically adjustable with respect to said card transport drum and so that the vertical dimension of said gate can be varied.

* * * * *